US005140356A

United States Patent [19]

Ohba et al.

[11] Patent Number: 5,140,356

[45] Date of Patent: Aug. 18, 1992

[54] LIGHT-SENSITIVE MATERIAL PROCESSING APPARATUS

[75] Inventors: Hisao Ohba, Kanagawa; Hisao Kanzaki, Shizuoka, both of Japan

[73] Assignee: Fuji Photo Film Co., Ltd., Kanagawa, Japan

[21] Appl. No.: 573,764

[22] Filed: Aug. 28, 1990

[30] Foreign Application Priority Data

Aug. 31, 1989 [JP] Japan ..... 1-225326

[51] Int. Cl.[5] ..... G03D 3/02

[52] U.S. Cl. ..... 354/320; 354/324; 354/325

[58] Field of Search ..... 354/317, 319, 320, 324, 354/325

[56] References Cited

U.S. PATENT DOCUMENTS

| | | | |
|---|---|---|---|
| 3,732,808 | 5/1973 | Graham | 354/319 |
| 3,916,426 | 10/1975 | Bown | 354/319 |
| 4,215,927 | 8/1980 | Grant et al. | 354/317 |
| 4,752,283 | 6/1988 | Copeland et al. | 354/324 |
| 4,969,002 | 11/1990 | Nakayama | 354/325 |

FOREIGN PATENT DOCUMENTS 63-121050 5/1988 Japan .

*Primary Examiner*—L. T. Hix
*Assistant Examiner*—D. Rutledge
*Attorney, Agent, or Firm*—Sughrue, Mion, Zinn, Macpeak & Seas

[57] ABSTRACT

A light sensitive material processing apparatus for applying a finisher onto obverse and reverse surfaces of an image-exposed sheet-like, light-sensitive material while the light-sensitive material is being conveyed with one surface of the light-sensitive material facing substantially upward after the light-sensitive material has been developed, during automatic conveyance of the light-sensitive material. The apparatus includes a first processing device for applying the finisher onto the one surface of the light-sensitive material and holding the finisher in a state in which the finisher is placed on the one surface for a predetermined time so as to effect processing of the one surface; and a second processing device for applying the finisher onto another surface of the light-sensitive material and for maintaining a state of contact between the finisher and the other surface for a time substantially equal to the predetermined time so as to effect processing of the other surface. Accordingly, surfaces both of the light-sensitive material are uniformly processed by the finisher.

5 Claims, 4 Drawing Sheets

LIGHT-SENSITIVE MATERIAL PROCESSING APPARATUS

BACKGROUND OF THE INVENTION

1. Field of the Invention

The present invention relates to a light-sensitive material processing apparatus for applying a finisher to an image-wisely exposed on a light-sensitive material while the light-sensitive material is being conveyed after the light-sensitive material has been subjected to development by being automatically conveyed in a developer.

2. Description of the Related Art

A light-sensitive material on which an image has been exposed, e.g., a presensitized planographic printing plate, is transported into a presensitized printing plate processor, which is a light-sensitive material processing apparatus. The printing plate is subjected to development in a developing tank provided in the presensitized printing plate processor, and is then washed in a rinsing tank or a washing tank before a finisher, i.e., finishing solution, is applied thereto.

Spray pipes with discharge ports oriented toward the obverse and reverse surfaces of the light-sensitive material as well as a conveying means for conveying the light-sensitive material are placed on the both sides of a conveying passage for the light-sensitive material in a finisher tank where the aforementioned finisher is applied to the light-sensitive material.

The finisher is applied onto the obverse and reverse surfaces of the light-sensitive material while the light-sensitive material is being conveyed, preferably in the declinate transporting direction, through the finisher tank. Thus, the finisher is applied to the obverse and reverse surfaces of the light sensitive material.

However, when applying the finisher to the light-sensitive material, since the light-sensitive material is conveyed and the finisher is applied to both surfaces of the light-sensitive material. However but on the reverse surface side the finisher drips off by its own weight. For this reason, the processing time with the finisher applied to the obverse surface of the light-sensitive material differs from the processing time with the finisher applied to the reverse surface of the light-sensitive material, so that it is impossible to provide both surfaces with finisher processing equally, and it is impossible to thoroughly apply the finisher onto the reverse surface of the light-sensitive material. Consequently, there has been uneven processing of the reverse surface of the light-sensitive material.

As a result of the unevenness of the processing, it has been impossible to obtain a high quality print.

SUMMARY OF THE INVENTION

Accordingly, an object of the present invention is to provide a light-sensitive material processing apparatus which is capable of thoroughly applying a finisher onto the reverse surface of a light-sensitive material, thereby overcoming the above-described drawbacks of the conventional art.

To this end, in accordance with the present invention, there is provided a light-sensitive material processing apparatus for applying a finisher onto obverse and reverse surfaces of an image exposed sheet-like, light-sensitive material while the light-sensitive material is being conveyed with one surface of the light-sensitive material facing substantially upward after the light-sensitive material has been developed during automatic conveyance of the light-sensitive material, the apparatus comprising: first processing means for applying the finisher onto one surface of the light-sensitive material and holding the finisher in a state in which the finisher is placed on the one surface for a predetermined time so as to effect processing of the one surface; and second processing means for applying the finisher onto another surface of the light-sensitive material and for maintaining a state of contact between the finisher and the other surface for a time substantially equal to the predetermined time so as to effect processing of the other surface.

In the above-described configuration, the finisher is applied to one surface, i.e., the obverse surface (upper surface), of the light-sensitive material by the first processing means, and the finisher thus applied is maintained on the one surface for a predetermined time, so that the one surface is processed with the finisher. On the other hand, the finisher is applied to the other surface, i.e., the reverse surface (back surface), of the light-sensitive material by the second processing means, and the finisher is maintained in a state of contact with the other surface for a time substantially equal to the predetermined time. Accordingly, both surfaces of the light-sensitive material are substantially uniformly processed with the finisher.

As a means for maintaining the state of contact between the finisher and the other surface, for instance, it is possible to conceive a flat plate or the like which is disposed in face-to-face relation with the other surface and is adapted to prevent the finisher applied to the other surface from dripping off, thereby maintaining the state of contact between the finisher and the other surface. In addition, as another means of maintaining the state of contact, it is possible to conceive an arrangement for allowing the finisher to be applied to the other surface through a plurality of stages along the advancing direction of the light-sensitive material, and for maintaining the state of contact between the finisher and the other surface for a time substantially equal to the aforementioned predetermined time.

In one embodiment, the second processing means comprises a storage section to which the finisher is supplied and in which it is stored; a finisher discharge port having an opening oriented toward the (back) surface of the light-sensitive material over an entire range in the transverse direction of the light-sensitive material; and a rectifying section for allowing the finisher discharged from the finisher discharge port to be held onto the other surface of the light-sensitive material. Accordingly, the finisher stored in the finisher storing section is discharged from the finisher discharge port onto the other surface of the light-sensitive material by means of the second processing means for applying the finisher onto the other surface, thereby allowing the finisher to be thoroughly applied to the other surface of the light-sensitive material by virtue of the rectifying section.

In the second embodiment, the second processing means comprises a spray pipe provided with a discharge port having an opening oriented toward the other surface of the light-sensitive material, the finisher being discharged from the opening; and a rectifying plate which is provided with a communicating hole communicating with the discharge port of the spray pipe and allowing the finisher to be discharged to the other surface of the light-sensitive material, and which is adapted to allow the finisher discharged to the other surface of the light-sensitive material to be held onto the other surface of the light-sensitive material. Thus, the finisher is discharged to the other surface of the light-sensitive material through the finisher discharge port. The finisher thus discharged is held onto the other surface of the light-sensitive material by means of the rectifying plate. As a result, the finisher is applied reliably onto the other surface of the light-sensitive material.

In still another embodiment, the second processing means comprises a spray pipe in which a plurality of finisher discharge ports are formed with openings arranged in a zigzag manner in face-to-face relation with the other surface of the light-sensitive material. Accordingly, the finisher is discharged from the finisher discharge ports arranged in a zigzag manner onto the other surface of the light-sensitive material in a zigzag manner. In this case, the range of discharge of the finisher discharged onto the other surface of the light-sensitive material is extensive. As a result, it is possible to thoroughly apply the finisher onto the other surface of the light-sensitive material.

Thus, in accordance with the present invention, since it is possible to thoroughly apply the finisher onto the other surface, i.e., the back surface, of the light-sensitive material, both the obverse (upper) and reverse (back) surfaces of the light-sensitive material are subjected to processing with the finisher for substantially identical time durations. As a result, an outstanding advantage can be obtained in that both the upper and back surfaces of the light-sensitive material can be processed uniformly, so that a print of excellent quality can be obtained.

The above and other objects, features and advantages of the present invention will become more apparent from the following detailed description of the invention when taken in conjunction with the accompanying drawings.

DESCRIPTION OF THE PREFERRED EMBODIMENTS

Figure 1:
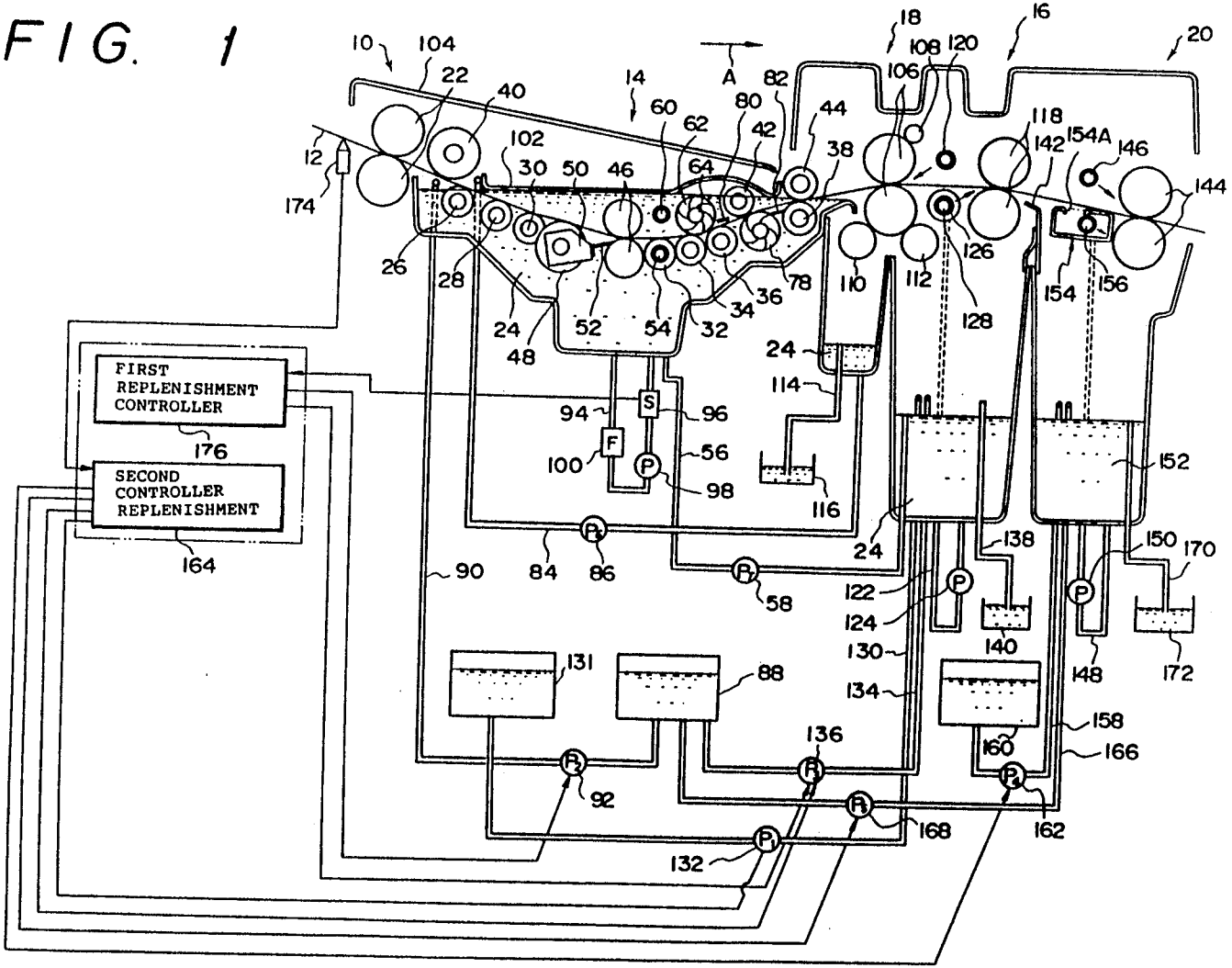
FIG. 1 is a schematic diagram illustrating an embodiment of a presensitized printing plate processor in accordance with the present invention.

FIG. 1 illustrates an embodiment of a presensitized printing plate processor 10 which is an example of a light-sensitive material processing apparatus in accordance with the present invention.

The presensitized printing plate processor 10 comprises a first developing tank 14 for developing a presensitized printing plate (hereafter referred to as PS plate) 12 with an image exposed by a printer (not shown); a second developing tank 16 for auxiliarily developing the PS plate 12; an overflow tank 18 interposed between the first developing tank 14 and the second developing tank 16; and a finisher tank 20 for applying a finisher 152 to the PS plate 12.

First Developing Tank

As shown in FIG. 1, a pair of conveying rollers 22 are disposed adjacent to the first developing tank 14, for inserting the PS plate 12 therein. The PS plate 12 with an image exposed thereon by the printer (not shown) is inserted between the pair of conveying rollers 22. The inserted PS plate 12 is conveyed into the presensitized printing plate processor 10 in a conveying direction (in the direction of arrow A in FIG. 1).

The upper side of the first developing tank 14 is open, and a central portion of its bottom projects downward, thereby forming a configuration of a substantially dish. A deveoper 24 is accommodated in the first developing tank 14. Guide rollers 26, 28, 30, 32, 34, 36 and 38 having the same diameter are disposed inside the first developing tank 14 along bottom wall portions thereof. These guide rollers 26 to 38 are split-type rollers in which a plurality of resilient roller members are pivotally supported on outer peripheries of their shafts. The shafts are supported by spanning an unillustrated pair of side plates.

A guide roller 40 having a diameter larger than that of the guide roller 26 is disposed above the guide roller 26, while a guide roller 42 is disposed above the guide roller 36. A guide roller 44 is disposed above the guide roller 38. These guide rollers 40, 42 and 44 are supported on the unillustrated pair of side plates in the same way as the guide rollers 26 to 38.

A pair of conveying rollers 46 are interposed between the guide roller 30 and the guide roller 32 in a central portion of the first developing tank 14. This pair of conveying rollers 46 are supported by the unillustrated pair of side plates, and rotate as a driving force of an unillustrated driving means is imparted thereto.

A guide roller 48 having a diameter larger than that of the guide roller 30 is interposed between the pair of conveying rollers 46 and the guide roller 30. This guide roller 48 is a split-type roller and is supported by the unillustrated pair of side plates in the same way as the guide rollers 26 to 38. A guide 52 is supported to the guide roller 48 via a bracket 50. The guide 52 has one end fixed to the bracket 50 and the other end oriented toward the pair of conveying rollers 46. The PS plate 12 is guided between the pair of conveying rollers 46 by the guide 52.

Accordingly, the PS plate 12 fed to the first developing tank 14 by the pair of conveying rollers 22 is inserted between the guide roller 26 and the guide roller 40. The PS plate 12 is then guided by the guide rollers 28, 30 and 48 diagonally downward, and then inserted between the pair of conveying rollers 46 by the guide 52. After passing through the pair of conveying rollers 46, the PS plate 12 is guided by the guide rollers 32, 34, 42 and 38 diagonally upward, and is then fed out toward the overflow tank 18 while being guided by the guide roller 44. Thus the PS plate 12 is immersed in the developer 24 in the first developing tank 14 and is subjected to development.

The guide roller 32 is formed in such a manner that a plurality of resilient rotating members are pivotally supported on an outer periphery of a spray pipe 54 with a plurality of discharge ports formed along the axial direction thereof. This spray pipe 54 communicates with one end of a pipeline 56. The other end of the pipeline 56 passes through a bottom portion of the second developing tank 16 and is open inside the second developing tank 16. Disposed midway the pipeline 56 is a supply pump 58 ($P_7$) whereby the developer 24 inside the second developing tank 16 is supplied into the spray pipe 54.

A spray pipe 60 is disposed above the guide roller 32. The spray pipe 60 has a plurality of discharge ports which are formed along the axial direction thereof and are open toward the pair of conveying rollers 46. This spray pipe 60 also communicates with the pipeline 56, and the developer 24 in the second developing tank 16 is supplied thereto by the supply pump 58.

A brush 62 is interposed between the spray pipe 60 and the guide roller 42. The brush 62 has a rotating shaft 64 rotatably supported by the unillustrated pair of side plates and rotates as a driving force of an unillustrated driving means is imparted thereto.

The brush 62 has an elongated carpet brush spirally wound around and adhered to the rotating shaft 64 via a nylon sheet (not shown). The carpet brush is formed of nylon, ETEF, PPS, PP, or the like. The outside diameter of the brush 62 is 40 mmΦ or less, preferably 20 to 40 mmΦ, while the diameter of the bristle of the carpet brush is set at 20 to 70μ. The number of revolutions of the brush 62 is set at 300 r.p.m. or less, preferably 60 to 200 r.p.m.

In addition, the brush 62 may be formed by providing its rotating shaft 64 with a spiral groove and by inserting an unillustrated twisted brush into the groove and winding the same around the shaft 64. In this case, the twisted brush is formed by twisting two wires having bristles therebetween to fix the bristles. If the wires of the twisted brush are inserted into the groove, the bristles project uniformly to the outside of the groove in a spreading manner, and the radially projecting bristles are thus disposed uniformly around the rotating shaft. The twisted brush is formed of the same material as that of the aforementioned carpet brush.

As shown in FIG. 1, a brush 78 having the same construction as that of the brush 62 is disposed underneath a conveying passage of the PS plate 12 between the guide roller 36 and the guide roller 38.

A spring-up preventing plate 80 is disposed on the guide roller 42 side of the brush 62. The spring-up preventing plate 80 serves to prevent the up and down movements of a rear-end of the PS plate 12 which has passed between the brush 62 and the guide roller 36. Furthermore, another spring-up preventing plate 82 is disposed between the brush 78 and the guide roller 38. The spring-up preventing plate 82 serves to prevent the up and down movements of the rear-end of the PS plate 12 in the same way as the spring-up preventing plate 80.

A pipeline 84 communicating with a bottom of the overflow tank 18 has an open end above the first developing tank 14. A supply pump 86 ($P_6$) is disposed midway the pipeline 84. In addition, a pipeline 90 communicating with a water supply tank 88 has an open end above the first developing tank 14, and a water supply pump 92 ($P_2$) is disposed midway the pipeline 90. This water supply pump 92 is connected to a first replenishment controller 176 using a conductivity measurement principle, which will be described later. The first replenishment controller 176 controls the timing at which water is supplied to the first developing tank 14.

One end of a pipeline 94 communicates with a lower portion of the first developing tank 14. A conductivity detector 96 (S), a circulation pump 98, and a filter 100 (F) are disposed midway the pipeline 94. The other end of the pipeline 94 communicates again with the lower portion of the first developing tank 14. Accordingly, after the developer 24 stored in the lower portion of the first developing tank 14 passes through the pipeline 94 and through the conductivity detector 96 and the filter 100, the developer 24 is sent again to the first developing tank 14. As a result, the electrical conductivity of the developer 24 is detected, dregs in the developer 24 is removed, and the developer 24 inside the first developing tank 14 is stirred.

The conductivity detector 96 detects the electrical conductivity of the developer 24 in the first developing tank 14 by detecting the electrical conductivity of the developer 24 passing through the pipeline 94, and transmits the detected result to the replenishment controller 176.

The developer in the first developing tank 14 is covered by a developer surface cover 102. The movement of the developer surface cover 102 in the direction of conveyance of the PS plate 12 is restricted by an unillustrated stopper, but the movement of the developer surface cover 102 in the vertical direction of the developer level is not restricted. Accordingly, when the amount of the developer 24 in the first developing tank 14 becomes small and the level of the developer 24 is thereby lowered, the developer surface cover 102 also moves downward correspondingly. As a result, the developer surface cover 102 prevents the deterioration of the developer 24 which can occur as the developer 24 is brought into contact with carbon dioxide contained in the air. In addition, the developer surface cover 102 also prevents the evaporation of the developer 24 in the first developing tank 14.

A guide cover 104 for re-entry is disposed above the first developing tank 14. The guide cover 104 guides the insertion of the PS plate 12 which has once been processed into the second developing tank 16, by jumping the first developing tank 14, so as to effect both development and finisher processing again.

Overflow Tank

An upper portion of a side wall of the first developing tank 14 located on the overflow tank 18 side is folded toward the overflow tank 18. The developer 24 in the first developing tank 14 overflows from this upper portion of the side wall so as to be recovered in the overflow tank 18.

A pair of conveying rollers 106 are disposed above the side walls serving as a partition between the overflow tank 18 and the second developing tank 16. The pair of conveying rollers 106 are rotatably supported by the unillustrated side plates, and rotate as a driving force of the unillustrated driving means is imparted thereto. The PS plate 12 fed out from between the guide rollers 38, 44 is inserted between the pair of conveying rollers 106.

A small-diameter roller 108 is disposed in a contact relationship with the upper one of the pair of conveying rollers 106. The roller 108 prevents the developer 24 in the second developing tank 16 attached to the upper one of the pair of conveying rollers 106 from dropping into the overflow tank 18.

A roller 110 disposed in the overflow tank 18 and a roller 112 disposed in the second developing tank 16 abut against the lower one of the pair of conveying rollers 106. The roller 110 prevents the developer 24 of the first developing tank 14 brought out by the PS plate 12 and adhered to the lower one of the conveying rollers 106 from dropping into the second developing tank 16. Meanwhile, the roller 112 prevents the developer 24 in the second developing tank 16 from dropping into the overflow tank 18.

A pipeline 114 passing through the bottom of the overflow tank 18 has one end extending from the bottom up to a predetermined height. The height of the level of the developer 24 in the overflow tank 18 is determined by the height of this pipeline 114 from the bottom of the overflow tank 18. The other end of the pipeline 114 is open in a drain tank 116.

Second Developing Tank

A pair of conveying rollers 118 are disposed in an upper portion of the second developing tank 16 adjacent to the finisher tank 20. The pair of conveying rollers 118 are rotatably supported by the unillustrated side plates, and rotate as a driving force of the unillustrated driving means is imparted thereto. The PS plate 12 fed out from between the pair of conveying rollers 106 is inserted between the pair of conveying rollers 118. As a result, the PS plate 12 is conveyed in an upper portion of the second developing tank 16 substantially horizontally.

A spray pipe 120 having the same construction as that of the aforementioned spray pipe 60 is disposed above the conveying passage of the PS plate 12 between the upper one of the pair of conveying rollers 106 and the upper one of the pair of conveying rollers 118. Discharge ports of the spray pipe 120 for discharging the developer 24 are open toward the upper one of the pair of conveying rollers 106, and discharge the supplied developer 24 to between the upper one of the pair of conveying rollers 106 and the upper surface of the PS plate 12. The spray pipe 120 communicates with one end of a pipeline 122. The other end of the pipeline 122 communicates with the bottom of the second developing tank 16, a circulation pump 124 being disposed midway the pipeline 122. The developer 24 is stored in the lower portion of the second developing tank 16, and the developer 24 is supplied into the spray pipe 120 by the operation of the circulation pump 124. Thus the developer 24 is discharged and applied to the upper surface of the PS plate 12.

A guide roller 126 is disposed underneath the conveying passage of the PS plate 12 in correspondence with the spray pipe 120. The guide roller 126 is formed in such a manner that a plurality of resilient rotating members are pivotally supported on an outer periphery of a spray pipe 128 with a plurality of discharge ports formed along the axial direction thereof, in the same way as the guide roller 32. This spray pipe 128 communicates with the pipeline 122, and the developer 24 is supplied thereto by the operation of the circulation pump 124.

The spray pipe 128 has the plurality of discharge ports facing the space between the lower one of the pair of conveying rollers 118 and the reverse(back) surface of the PS plate 12. Thus the developer 24 supplied is discharged and applied to the reverse surface of the PS plate 12.

One end of a pipeline 130 communicates with the second developing tank 16. The other end of the pipeline 130 communicates with a concentrated developer tank 131. A replenishing developer supply pump 132 ($P_1$) is disposed midway the pipeline 130. The replenishing developer supply pump 132 is connected to a second replenishment controller 164 which will be described later, and its operation is thereby controlled.

In addition, one end of a pipeline 134 communicates with the second developing tank 16. The other end of the pipeline 134 communicates with the water supply tank 88. A water supply pump 136 ($P_3$) is disposed midway the pipeline 134. The water supply pump 136 is connected to the first replenishment controller 176 as well as the second replenishment controller 164. Its operation is thereby controlled.

Also, one end of a pipeline 138 projects upward through the bottom of the second developing tank 16. The other end of the pipeline 138 is open in a drain tank 140, and the developer 24 overflowing through the pipeline 138 is discharged to the drain tank 140.

Finisher Tank

A partition plate 142 is erected on the side walls partitioning the second developing tank 16 and the finisher tank 20. This partition plate 142 prevents the developer 24 attached to the pair of conveying rollers 118 from mixing into the finisher 152 accommodated in the finisher tank 20.

A pair of conveying rollers 144 are disposed in an upper portion of the finisher tank 20 adjacent to the exit of the PS plate 12. The pair of conveying rollers 144 are rotatably supported by the unillustrated side plates, and rotate as a driving force of the unillustrated driving means is imparted thereto. The pair of conveying rollers 144 are arranged at a slightly lower position than the pair of conveying rollers 118. The PS plate 12 fed out from between the pair of conveying rollers 118 is inserted between the pair of conveying rollers 144. Thus the PS plate 12 is conveyed through the upper portion of the second developing tank 16 diagonally downward.

A spray pipe 146 having the same construction as that of the aforementioned spray pipe 54 is disposed above the conveying path of the PS plate 12 between the pair of conveying rollers 118 and the pair of conveying rollers 144. The discharge ports of the spray pipe 146 for discharging the finisher 152 are open toward the upper one of the pair of conveying rollers 144, and discharge the supplied finisher 152 between the upper one of the pair of conveying rollers 144 and the upper surface of the PS plate 12. The spray pipe 146 communicates with one end of the pipeline 148. The other end of the pipeline 148 communicates with a bottom portion of the finisher tank 20, a circulation pump 150 being disposed midway the pipeline 148. The finisher 152 is stored in a lower portion of the finisher tank 20, and the finisher 152 is supplied into the spray pipe 146 by the operation of the circulation pump 150. Thus the finisher 152 is discharged and applied to the upper surface of the PS plate 12.

Figure 2:
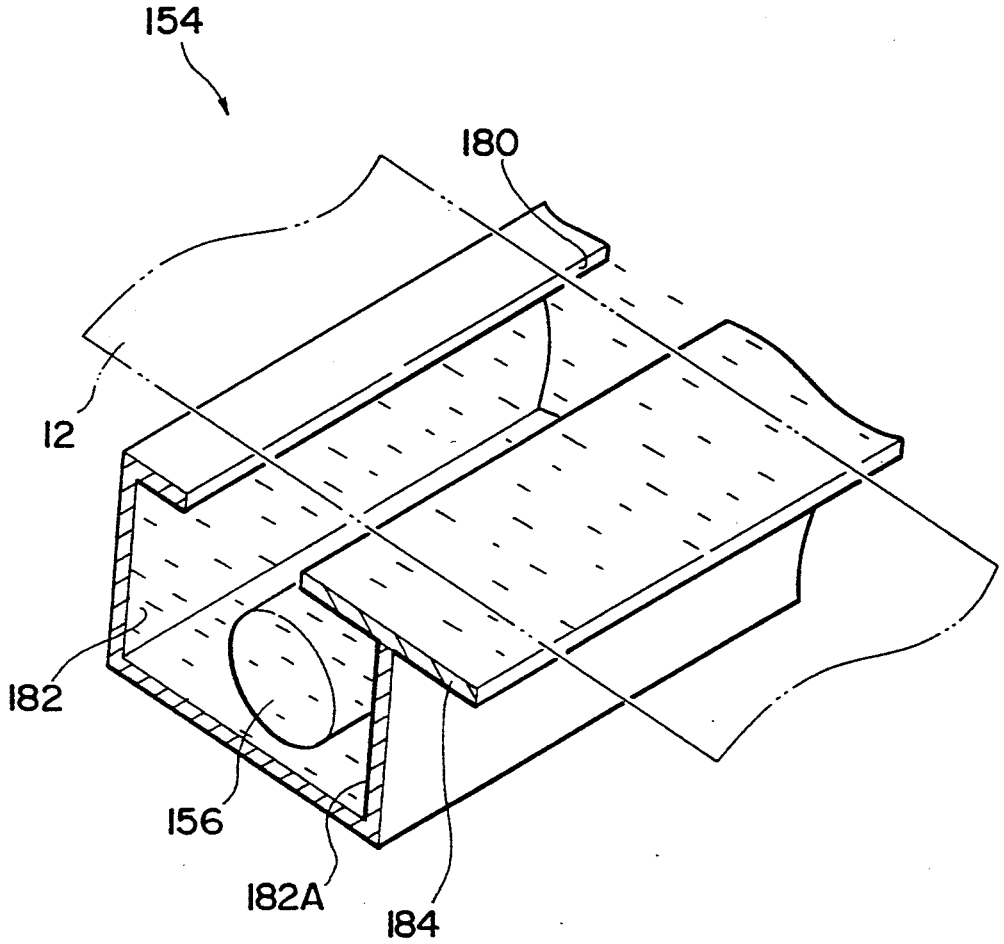
FIG. 2 is a perspective view illustrating a finisher applying box.

A finisher applying box 154 is disposed underneath the conveying passage of the PS plate 12 in correspondence with the spray pipe 146. As shown in FIG. 2, the finisher applying box 154 has a substantially U-shaped cross section, and is constituted by a finisher storage section 182 having a finisher discharge port 180 formed along the transverse direction of the PS plate 12 as well as a rectifying plate 184 fixed to the finisher applying box 154 and covering part of the finisher discharge port 180.

A spray pipe 156 is disposed in the finisher storage section 182. This spray pipe 156 has a plurality of discharge ports formed along the axial direction thereof in the same way as the spray pipe 146. The discharge ports are oriented toward a corner 182A of the finisher storage section 182. The spray pipe 156 communicates with a pipeline 148, and the finisher 152 is supplied into the finisher storage section 182 through the spray pipe 156 by the operation of the circulation pump 150. The finisher 152 supplied into the finisher storage section 182 is discharged from the finisher discharge port 180 and flows out on the rectifying plate 184. The finisher 152 is retained on the rectifying plate 184 so as to maintain a state of contact with the reverse surface of the PS plate 12. Thus the finisher 152 is thoroughly applied to the reverse surface of the PS plate 12.

The time duration for applying the finisher 152 to the reverse(back) surface of the PS plate 12 is not less than 0.5 sec., preferably not more than 1.5 sec. In addition, the flow rate of the finisher 152 supplied to the spray pipe 156 is set at 4 l/min. to 15 l/min.

In addition, the time duration for processing with the finisher applied to the reverse surface of the PS plate 12 is set to be substantially the same as the time duration for processing with the finisher applied to the upper(obverse) surface of the PS plate 12.

One end of a pipeline 158 communicates with the finisher tank 20. The other end of the pipeline 158 communicates with a concentrated finisher tank 160. A replenishing finisher supply pump 162 ($P_4$) is disposed midway the pipeline 158. The replenishing finisher supply pump 162 is connected to the second replenishment controller 164, and its operation is thereby controlled.

Also, one end of a pipeline 166 communicates with the finisher tank 20. The other end of the pipeline 166 communicates with the water supply tank 88. A water supply pump 168 ($P_5$) is disposed midway the pipeline 166. This water supply pump 168 is connected to the first replenishment controller 176 and the second replenishment controller 164, and its operation is thereby controlled.

In addition, one end of a pipeline 170 projects upward through the bottom of the finisher tank 20. The projecting height of the pipeline 170 into the finisher tank 20 sets the height of the level of the finisher 152 in the finisher tank 20. The other end of the pipeline 170 is open in a drain tank 172. Accordingly, the finisher 152 overflowing into the pipeline 170 is discharges to the drain tank 172.

A detector 174 connected to the second replenishment controller 164 is disposed on the PS plate insertion side of the pair of conveying rollers 22. The detector 174 detects the time duration of the passage of the PS plate 12 at the insertion port of the presensitized printing plate processor 10. The second replenishment controller 164 calculates the area of the PS plate 12 inserted into the presensitized printing plate processor 10 by incorporating into the calculation a processing speed for the PS plate 12 and a width of the PS plate 12 that are preset.

A description will now be given of the operation of this embodiment.

The PS plate 12 with an image exposed thereon by a printer (not shown) is inserted between the guide roller 40 and the guide roller 26 in the first developing tank 14 through the pair of conveying rollers 22, and is inserted into the first developing tank 14. The PS plate 12 is conveyed diagonally downward while being guided by the guide rollers 28, 30 and 48 and is fed to the central portion of the first developing tank 14.

The large-diameter guide roller 48 guides the leading end of the PS plate 12 without causing it to deviate from a predetermined conveying path, while the guide 52 functions to insert the leading end of the PS plate 12 between the pair of conveying rollers 46.

The PS plate 12 inserted between the pair of conveying rollers 46 and fed out therefrom is conveyed diagonally upward while being guided by the guide rollers 32, 34, 36, 42, 38 and 44, and is fed out from the first developing tank 14.

The both surfaces of the PS plate 12, while the PS plate 12 is being conveyed, are rubbed by the brushes 62 and 78 so as to scrape off unnecessary light-sensitive layers which have swollen or have been dissolved. Thus the PS plate 12 is developed.

Since the brushes 62 and 78 are formed with small diameters, their rotating shafts 64 and 70 are disposed in the developer 24. Hence, the amount of contact of the developer 24 with the air is reduced by virtue of the developer surface cover 102, with the result that the deterioration of the developer 24 is prevented and the first developing tank 14 can be made compact, thereby reducing the costs.

In addition, the developer 24 overflowing from the first developing tank 14 into the overflow tank 18 is discharged to the drain tank 116 through the pipeline 114.

The PS plate 12 processed by conveyance in the first developing tank 14 is developed nearly completely, and is further developed auxiliarily by passing through the second developing tank 16.

When the PS plate 12 is conveyed while being clamped by the pair of conveying rollers 46 in the developer 24 inside the first developing tank 14, the PS plate 12 is squeezed by the pair of conveying rollers 46, and immediately thereafter the developer 24 is sprayed onto the PS plate 12 by the spray pipes 54 and 60. Also, the developer 24 in the first developing tank 14 is circulated by these spray pipes 54 and 60.

The developer 24 discharged to the overflow tank 18 by overflowing from the first developing tank 14 is supplied again to the first developing tank 14 through the pipeline 84 by means of the pump 86, so that the developer 24 can be utilized effectively.

As the PS plate 12 fed out from the first developing tank 14 is being clamped and conveyed by the pair of conveying rollers 106, the developer 24 is squeezed off from the PS plate 12, and the PS plate 12 is fed out in between the pair of conveying rollers 118. The PS plate 12 thus fed out is then conveyed substantially horizontal while being guided by the guide roller 126 through the upper portion of the second developing tank 16.

Midway this conveyance, the developer 24 is applied to the both surfaces of the PS plate 12 by means of the spray pipes 120 and 128. As a result, the PS plate 12 is completely developed.

Although the developer 24 in the first developing tank 14 is fatigued owing to the development of the PS plate 12, the concentrated developer and water are replenished into the second developing tank 16 by the first replenishment controller 164. The developer 24 is replenished into the first developing tank 14 from the second developing tank 16, thereby recovering from fatigue. The developer 24 is discharged from the overflow tank 18 to the drain tank 116 via the pipeline 114.

Since the PS plate 12 to which the developer 24 is applied in the second developing tank 16 has already been subjected to development in the first developing tank 14, the deterioration of the developer 24 due to processing in the second developing tank 16 is reduced. Accordingly, since the developer 24 in the second developing tank 16 is supplied to the first developing tank 14, the developer 24 can be used for extended periods of time.

In addition, since the surface of the developer 24 in the first developing tank 14 is covered with the developer surface cover 102, the deterioration of the developer 24 due to the air is prevented, and the evaporation of the developer 24 is also prevented.

In consequence, the developer 24 can be used for extended periods of time on a stable basis for processing the PS plate 12.

Next, a description will be given of the replenishment of the developer 24.

In cases where a multiplicity of PS plates 12 are developed in the first developing tank 14, the developer 24 becomes fatigued. In order to effect recovery from the deterioration of the developer 24, the area of the PS plate 12 to be processed is detected by the detector 174, and a calculation is conducted by the second replenishment controller 164 so as to replenish a required amount of the developer 24.

Specifically, the arrangement provided is such that the area of the PS plate 12 to be processed is calculated by the second replenishment controller 164 on the basis of the value detected by the detector 174, the operating times of the replenishing developer supply pump 132 and the water supply pump 136 are calculated by the second replenishment controller 164 on the basis of the detected result. The replenishing developer supply pump 132 and the water supply pump 136 are operated so as to supply the replenishing developer and water by an amount corresponding to the area of the PS plate 12. Next, the supply pump 58 is operated for a fixed time so that the developer 24, the amount of which is equivalent to the amount replenished into the second developing tank 16 and which is substantially close to a new solution, can be supplied into the first developing tank 14.

The electrical conductivity of the developer 24 is detected by the conductivity detector 96, and if the developer 24 becomes condensed and the electrical conductivity increases above a predetermined value, the water supply pump 92 is operated by the first replenishment controller 176 so as to supply water into the first developing tank 14. In addition, with respect to the second developing tank 18 and the finisher tank 20 as well, the amount of water to evaporate is measured in advance, and the water supply pump 136 and the water supply pump 168 are operated in proportion to the operation of the water supply pump 92. The amount of water to be replenished is set at 10 cc to 1,000 cc/cycle.

The concentrated finisher and water are replenished to the finisher tank 20 by the replenishing finisher supply pump 162 and the water supply pump at fixed rates by being controlled by the second replenishment controller 164.

As a result, the condensation of the developer 24 and the finisher 152 are prevented, and as the activities of the developer 24 and the finisher 152 are maintained at constant levels, so that stable development over extended periods of time becomes possible.

The finisher 152 supplied into the storage section 182 of the finisher applying box 154 flows out from the finisher discharge port 180 and over the rectifying plate 184 and is supplied to the reverse (back) surface of the PS plate 12. At this time, the finisher 152 is retained onto the reverse surface of the PS plate 12 by means of the rectifying plate 184.

A description will now be given of another example of the means for applying the finisher onto the reverse surface of the PS plate.

Figure 3:
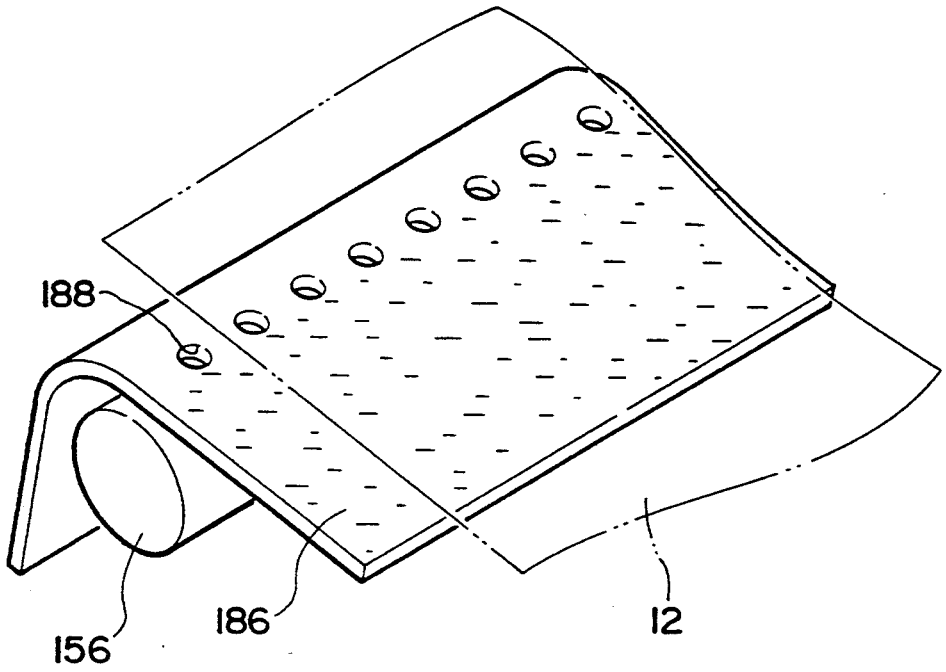
FIGS. 3 and 4 are perspective views illustrating another means for applying the finisher onto the reverse surface of a presensitized printing plate.

As shown in FIG. 3, a rectifying plate 186 is disposed in such a manner as to cover the spray pipe 156. This rectifying plate 186 has a plurality of finisher discharge ports 188 formed along the transverse direction of the PS plate 12. These finisher discharge ports 188 communicate with the plurality of finisher discharge ports (not shown) provided in the spray pipe 156.

Accordingly, the finisher 152 supplied into the spray pipe 156 is discharged from the finisher discharge ports 188 provided in the rectifying plate 186, flows out over the rectifying plate 186. Accordingly, the finisher 152 is held onto the reverse surface of the PS plate 12 by the rectifying plate 186.

Figure 4:
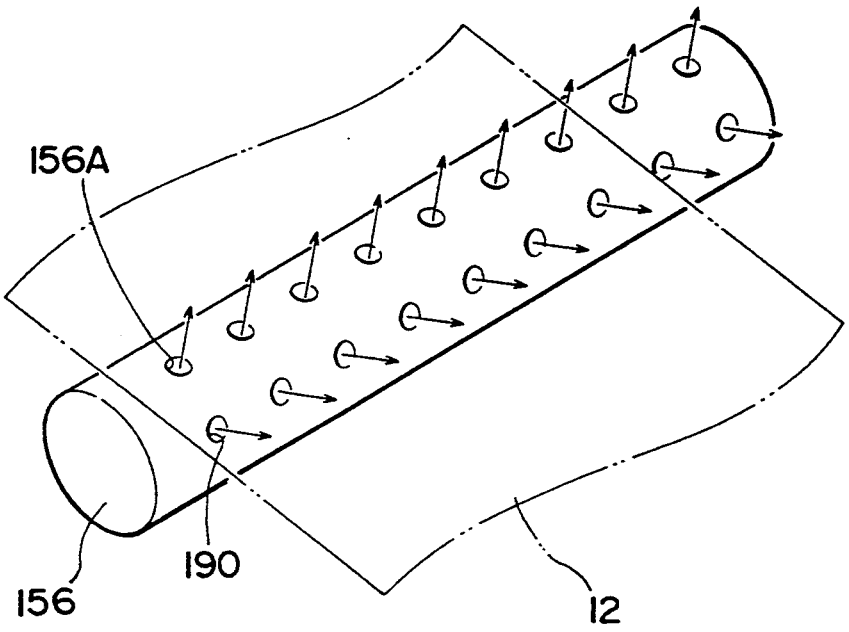

Furthermore, as shown in FIG. 4, the spray pipe 156 has a plurality of finisher discharge ports 156A provided at predetermined intervals along the axial direction of the spray pipe 156. Also, the spray pipe 156 has a plurality of finisher discharge ports 190 provided at predetermined intervals along the axial direction of the spray pipe 156 at axially different positions of the spray pipe 156 with respect to the finisher discharge ports 156A. In other words, the finisher discharge ports 190 are provided in correspondence with the intervals between the adjacent ones of the finisher discharge ports 156A. Thus, the finisher discharge ports 156A and the finisher discharge port 190 are provided in the spray pipe 156 in a zigzag manner.

As a result, the finisher 152 is discharged over an extensive range of the reverse surface of the PS plate 12, and is positively applied to the reverse surface of the PS plate 12.

It should be noted that the rectifying plates 184 and 186 respectively shown in FIGS. 2 and 3, and the spray pipe 156 shown in FIG. 4 may also be provided on the obverse surface side of the PS plate 12.

Thus, in the foregoing embodiments, the finisher 152 can be applied thoroughly onto the reverse surface of the PS plate 12 by means of the means for applying the finisher onto the reverse surface of the PS plate, so that it is possible to obtain high quality print.

In addition, in the foregoing embodiments, since the same finisher 152 may be applied to both the obverse and reverse surfaces of the PS plate 12, there are no differences in the application of the finisher to those surface sides.

Although in the embodiments an example of the ordinary presensitized printing plate 12 has been given as a light-sensitive material, the present invention is not restricted to the same, and the present invention can be applied to a developing apparatus for a light-sensitive recording material, such as a developing apparatus for a planographic printing plate using no water, as another example of light-sensitive material.

In accordance with the above-described embodiments, the time of application of the finisher 152 onto the reverse surface of the PS plate 12 can be prolonged. However, the embodiment which is capable of effecting processing most stably and uniformly is the one having the finisher applying box 154 shown in FIG. 2, followed in order by the one having the rectifying plate 186 shown in FIG. 3 and the one having the spray pipe 156 shown in FIG. 4 in which the finisher discharge ports 188, 190 are formed in a zigzag manner.

An arrangement may be alternatively provided such that, instead of the spray pipe 156 shown in FIG. 4, a plurality of spray pipes each having a row of finisher discharge ports formed in the longitudinal direction are arranged. The finisher is then applied to the light-sensitive material at a plurality of locations thereof along the advancing direction of the light-sensitive material. In this case, the spray pipes may be arranged in such a manner that the locations of application of the finisher onto the light-sensitive material are zigzagged.

What is claimed is:

1. A light-sensitive material processing apparatus for applying a finisher onto obverse and reverse surfaces of an image-exposed sheet-like light-sensitive material while the light-sensitive material is being conveyed with one surface of the light-sensitive material facing substantially upward after the light-sensitive material has been developed, during automatic conveyance of the light-sensitive material, said apparatus comprising:

first processing means for applying the finisher onto said one surface of the light-sensitive material and holding the finisher in a state in which the finisher is placed on said one surface for a predetermined time so as to effect processing of said one surface; and second processing means for applying the finisher onto another surface of said light-sensitive material and for maintaining a state of contact between the finisher and said another surface for a time substantially equal to said predetermined time so as to effect processing of said another surface, wherein said second processing means comprises an application section for applying the finisher and holding means for holding the finisher applied in the state of contact between the finisher and said another surface against gravity, said holding means is disposed in such a manner as to face said another surface and has a flat surface portion for allowing the finisher applied in said application section to be placed thereon and for maintaining the state of contact between the finisher and said another surface, said flat surface portion is disposed in such a manner as to be connected to said application section on the downstream side of said application section in an advancing direction of said light-sensitive material, and wherein said application section comprises a storage in which the finisher is stored, said storage section having an opening which faces said another surface, and said storage section being adapted to apply the finisher stored in said storage section onto said another surface via said opening.

2. A light -sensitive material processing apparatus according to claim 1, wherein said flat surface portion includes an upper surface of a plate extending from a downstream end of said opening of said storage section in the advancing direction of the light-sensitive material toward the downstream in the advancing direction of the light-sensitive material.

3. A light-sensitive material processing apparatus for applying a finisher onto obverse and reverse surfaces of an image-exposed sheet-like light-sensitive material while the light-sensitive material is being conveyed with one surface of the light-sensitive material facing substantially upward and with the light-sensitive material inclined downward along an advancing direction of the light-sensitive material after the light-sensitive material has been developed, during automatic transportation of the light-sensitive material, said apparatus comprising:

first processing means for applying the finisher onto said one surface of the light-sensitive material and holding the finisher in a state in which the finisher is placed on said one surface for a predetermined time so as to effect processing of said one surface;

applying means for applying the finisher onto another surface of said light-sensitive material; and holding means for maintaining the finisher applied by said applying means in a state of contact with said another surface for a time substantially equal to said predetermined time so as to effect processing of said another surface, said holding means includes placing means on which the finisher applied by said applying means is placed, said placing means comprises a planar member disposed downstream of said applying means in the advancing direction of the light-sensitive material, said applying means comprises a storage section in which the finisher is stored, said storage section having an opening which faces said another surface, and said storage section being adapted to apply the finisher stored in said storage section onto said another surface via said opening.

4. A light-sensitive material processing apparatus according to claim 3, wherein said planar member is formed integrally with said storage section.

5. A light-sensitive material processing apparatus according to claim 4, wherein an upward end of said planar member in the advancing direction of the light-sensitive material constitutes a downstream edge portion of said opening provided in said storage section in the advancing direction of the light-sensitive material.

* * * * *